US005409094A

United States Patent [19]

Muraco

[11] Patent Number: 5,409,094

[45] Date of Patent: Apr. 25, 1995

[54] VENDING MACHINE FOR BOTTLED WATER

[76] Inventor: Carl Muraco, 1572 Marine Pkwy., Brooklyn, N.Y. 11234

[21] Appl. No.: 125,153

[22] Filed: Sep. 23, 1993

[51] Int. Cl.[6] ..... G07D 5/00; G07F 13/00

[52] U.S. Cl. ..... 194/317; 222/2; 222/185

[58] Field of Search ..... 194/240, 303, 317, 350; 222/2, 185

[56] References Cited

U.S. PATENT DOCUMENTS

| | | | |
|---|---|---|---|
| 497,107 | 5/1893 | Westlake et al. | 222/2 X |
| 1,779,839 | 10/1930 | Bigelow | 222/2 X |
| 1,794,641 | 3/1931 | Payson et al. | 222/2 X |
| 1,857,764 | 12/1931 | Drummond | 222/2 |
| 2,734,659 | 2/1956 | Smith | 222/185 X |
| 2,792,920 | 5/1957 | Sutphen et al. | 222/2 X |
| 3,901,368 | 8/1975 | Klinger | 194/317 |
| 4,483,431 | 11/1984 | Pratt | 194/317 |
| 4,972,976 | 11/1990 | Romero | 222/185 |
| 5,042,635 | 8/1991 | Bell | 194/317 X |

FOREIGN PATENT DOCUMENTS

| | | | |
|---|---|---|---|
| 460589 | 2/1937 | United Kingdom | 222/2 |

*Primary Examiner*—Michael S. Huppert
*Assistant Examiner*—Scott L. Lowe
*Attorney, Agent, or Firm*—Michael I. Kroll

[57] ABSTRACT

A vending machine for bottled water is provided, which consists of a base to sit upon a floor in a building, so as to support a bottle of water thereon. A coin operated dispensing module is mounted to the base, so that when a coin is inserted into the dispensing module a specific amount of water from the bottle can be deposited into a cup placed into the dispensing module.

3 Claims, 3 Drawing Sheets

VENDING MACHINE FOR BOTTLED WATER

BACKGROUND OF THE INVENTION

1. Field of the Invention

The instant invention relates generally to bottled water coolers and more specifically it relates to a vending machine for bottled water.

2. Description of the Prior Art

Numerous bottled water coolers have been provided in prior art that are adapted to supply chilled water for drinking. While these units may be suitable for the particular purpose to which they address, they would not be as suitable for the purposes of the present invention as heretofore described.

SUMMARY OF THE INVENTION

A primary object of the present invention is to provide a vending machine for bottled water that will overcome the shortcomings of the prior art devices.

Another object is to provide a vending machine for bottled water that is coin operated to dispense a specific amount of the bottled water into a cup.

An additional object is to provide a vending machine for bottled water in which a dispensing module is mounted in a removable manner to a front wall of a base.

A further object is to provide a vending machine for bottled water that is simple and easy to use.

A still further object is to provide a vending machine for bottled water that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
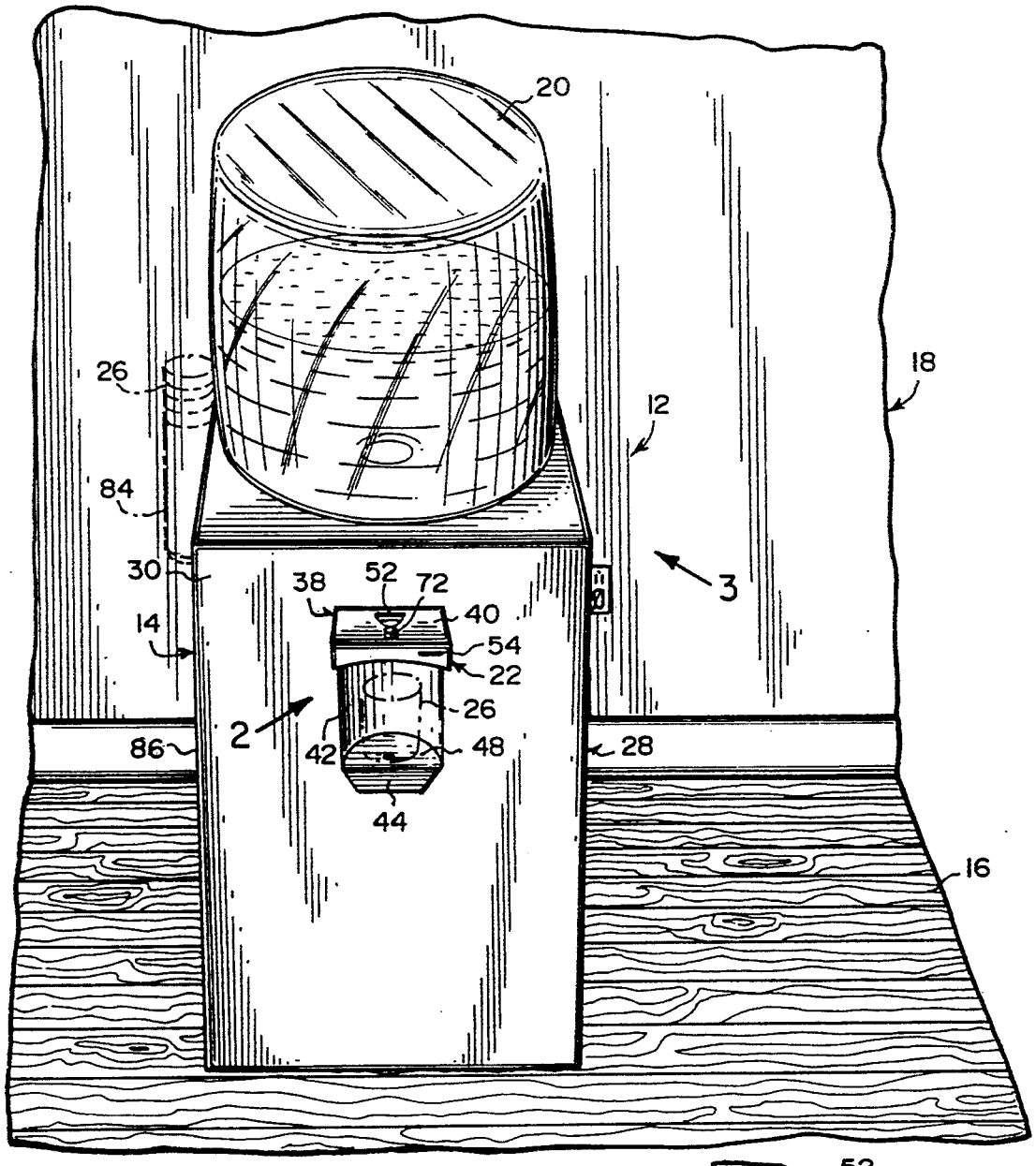
FIG. 1 is a front perspective view of the instant invention installed against a wall in a building.

Turning now descriptively to the drawings, in which similar reference characters denote similar elements throughout the several views, FIGS. 1 through 11 illustrate a vending machine 12 for bottled water, which consists of a base 14 to sit upon a floor 16 in a building 18, so as to support a bottle of water 20 thereon. A coin operated dispensing module 22 is mounted to the base 14, so that when a coin 24 is inserted into the dispensing module 22, a specific amount of water from the bottle 20 can be dispensed into a cup 26 placed into the dispensing module 22.

The base includes a box shaped housing 28, having a front wall 30 with a mounting area 32, for attaching the dispensing module 22 thereto. A water hose 34 extends between the bottle of water 20 and an upper portion of the mounting area 32 on the front wall 30. A return tube 36 extends between a lower portion of the mounting area 32 on the front wall 30 and a water storage compartment (not shown) within the box shaped housing 28 of the base 14.

The dispensing module 22 contains a generally C-shaped casing 38, having an upper portion 40, an intermediate portion 42 and a lower portion 44. A spigot 46 in the upper portion 40 of the casing 38 is fluidly coupled to the water hose 34, so as to dispense the water therefrom. A drip tray 48 is on the lower portion 44 of the casing 38, so as to hold the cup 26.under the spigot 46 and catch any water spilled from the cup 26. An overflow pipe 50 under the drip tray 48 is fluidly coupled to the return tube 36.

The upper portion 40 of the casing 38 has a coin intake slot 52 and a coin return slot 54 therein. An electrically powered coin discriminator 56 has a coin slot 58 directly under the coin intake slot 52 in the upper portion 40 of the casing 38. A coin reject chute 60 extends between the coin discriminator 56 and the coin return slot 54 in the upper portion 40 of the casing 38. If the coin discriminator 56 rejects a coin 24 inserted within the coin intake slot 52, it will enter the coin reject chute 60 and exit the coin return slot 54.

The lower portion 44 has a compartment 62 below the drip tray 48. A coin accept chute 64 in the intermediate portion 42, extends between the coin discriminator 56 and the compartment 62 in the lower portion 44. If the coin discriminator 56 accepts a coin 24 inserted within the coin intake slot 52, it will enter the coin accept chute 64 and drop into the compartment 62 in the lower portion 44.

A lever 66 is pivotally connected at 68 within the upper portion 40 of the casing 38. A valve 70 in the spigot 46 is attached to a first side of the lever 66. A spring biased button 72 is mounted on the upper portion 40 of the casing 38 and is attached to a second side of the lever 66. When the spring biased button 72 is depressed, the valve 70 will open the spigot 46 to allow some of the water to exit the spigot 46.

A mechanism 74 is for allowing the spring biased button 72 to be depressed, after a coin 24 inserted within the coin intake slot 52 is accepted by the coin discriminator 56. The mechanism 74 includes a solenoid 76 electrically connected via a circuit to the electrically powered coin discriminator 56. A yoke 78 extends from the solenoid 76 to normally engage with the spring biased button 72, to prevent the spring biased button 72 to be depressed. A coin 24 accepted by the coin discriminator 56 will cause the coin discriminator 56 to activate the solenoid 76, to pull the yoke 78 back and release the spring biased button 72, so that it can now be depressed.

A door 80 is hinged at 82 to one side of the compartment 62 in the lower portion 44, so as to gain access into the compartment 62 to remove coins 24 therefrom. A key operated lock 84 is in the door, to prevent an unauthorized removal of the coins 24 from the compartment 62 in the lower portion 44.

Figure 2:
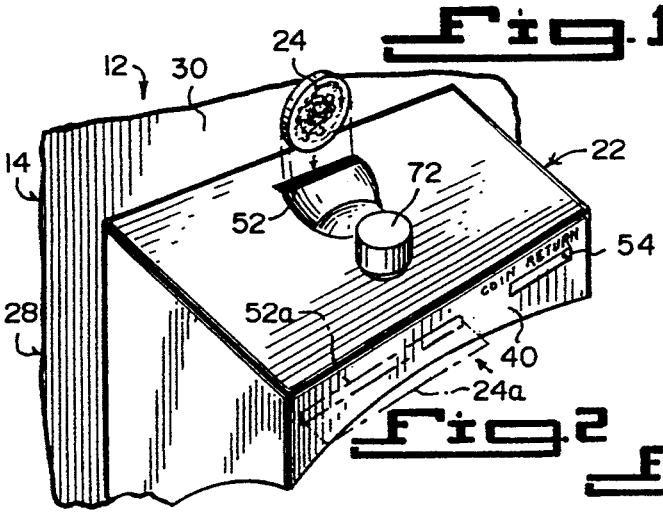
FIG. 2 is a left side perspective view of a portion of the instant invention taken in the direction of arrow 2 in FIG. 1.
Figure 3:
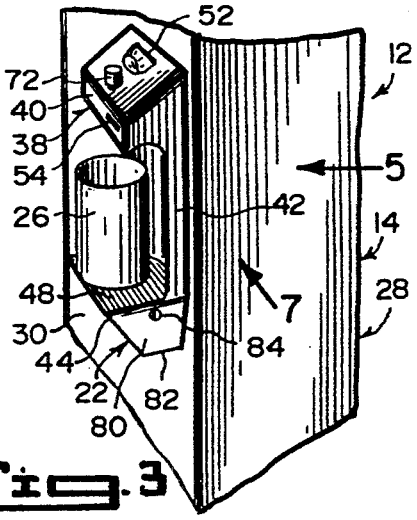
FIG. 3 is a right side perspective view of a portion of the instant invention taken in the direction of arrow 3 in FIG. 1.
Figure 5:
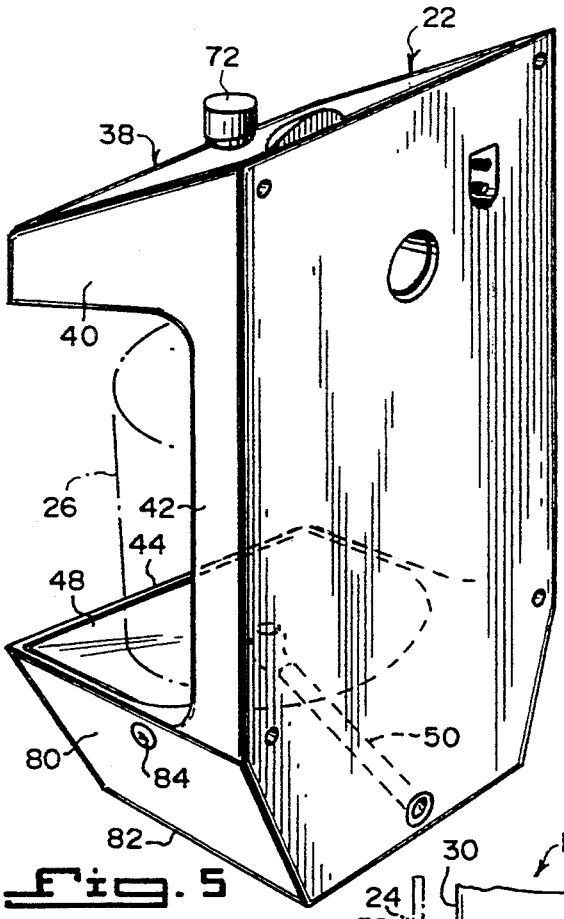
FIG. 5 is a rear perspective view of the dispensing module per se taken in the direction of arrow 5 in FIG. 3.
Figure 4:
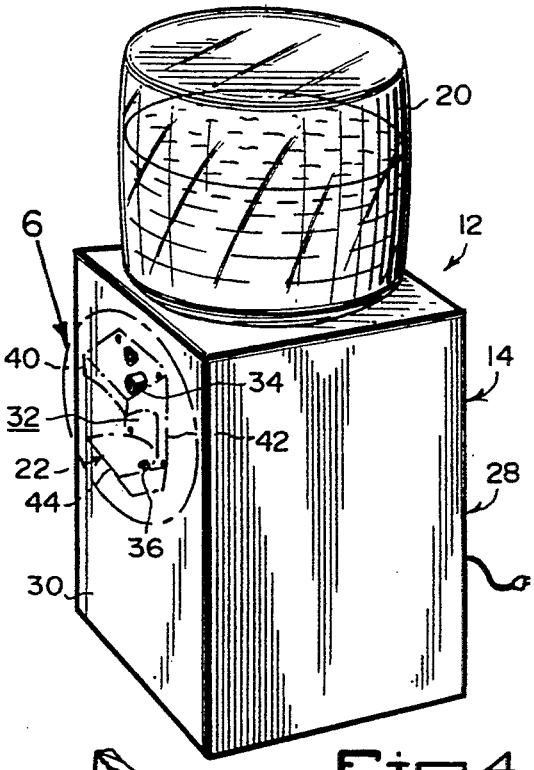
FIG. 4 is a right side perspective view of the instant invention showing the dispensing module in phantom.
Figure 6:
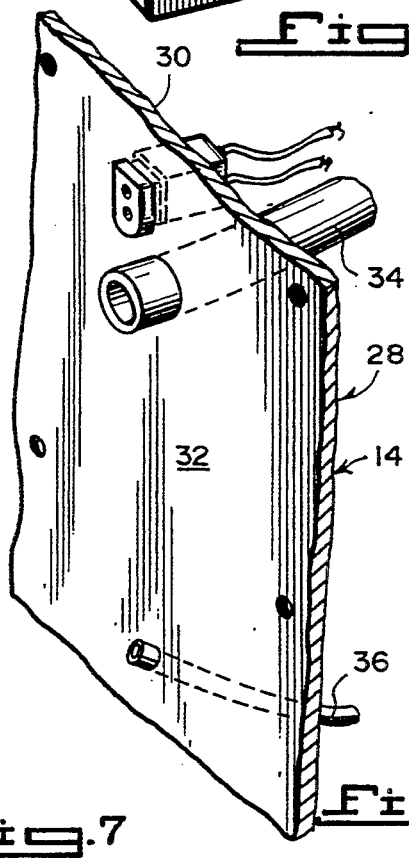
FIG. 6 is a front perspective view of a portion of the front wall mounting area as indicated by arrow 6 in FIG. 4.
Figure 7:
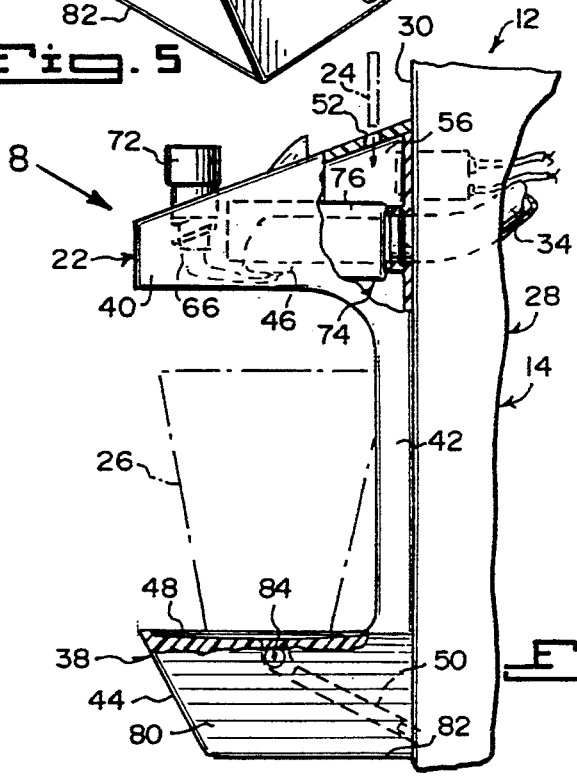
FIG. 7 is a side view with parts broken away taken in the direction of arrow 7 in FIG. 3.
Figure 8:
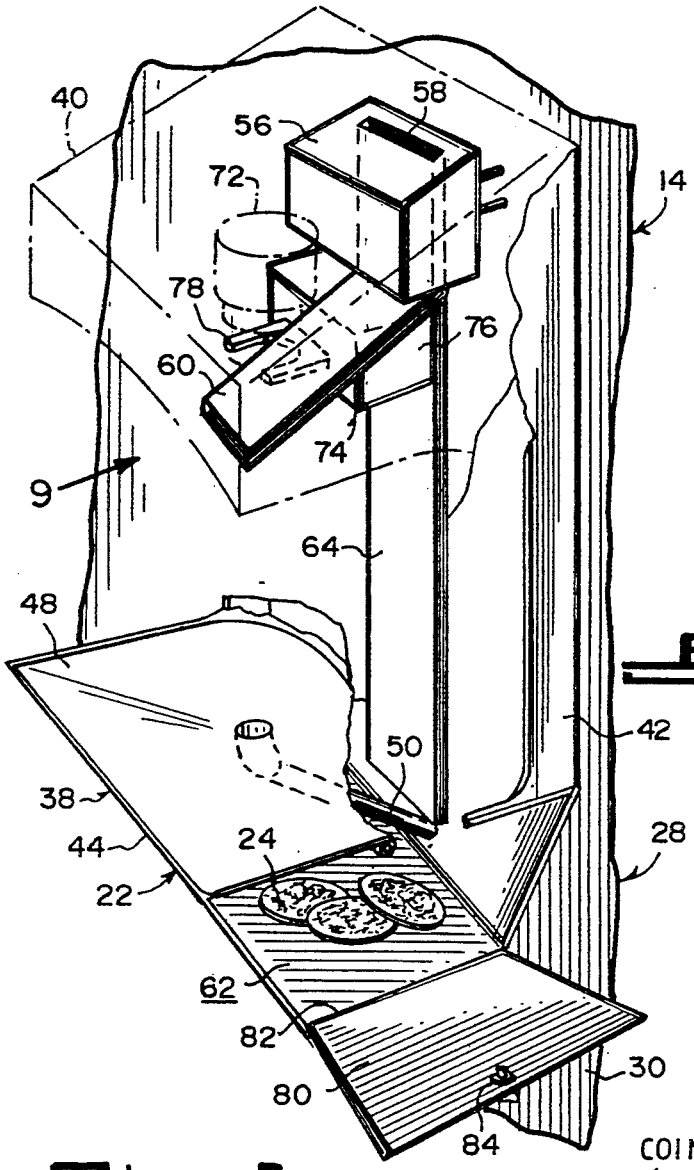
FIG. 8 is a right side perspective view with parts broken away, in phantom and the side door opened taken in the direction of arrow 8 in FIG. 7.
Figure 10:
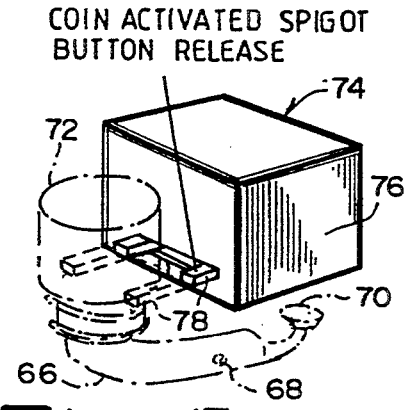
FIG. 10 is a perspective view of the spigot button release mechanism.
Figure 11:
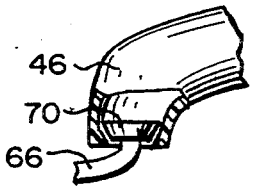
FIG. 11 is a side view with parts broken away, showing the spigot and valve in greater detail.
Figure 9:
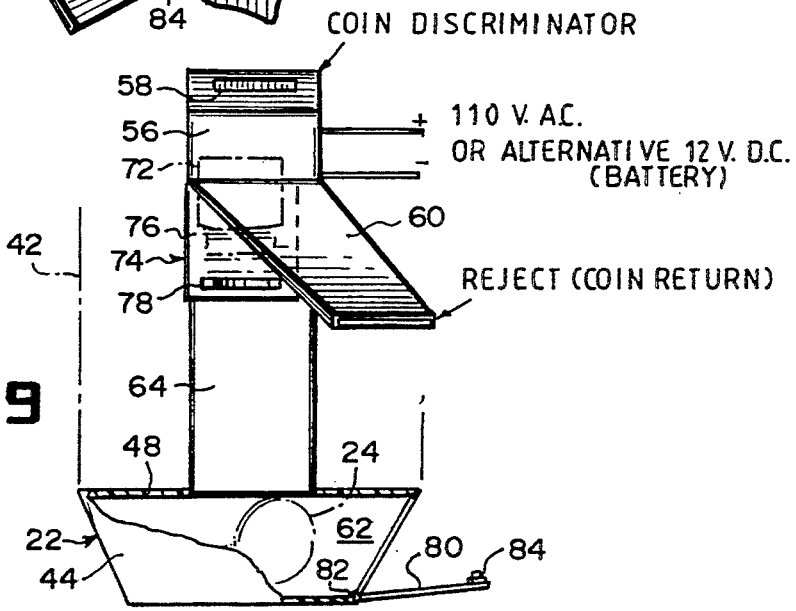
FIG. 9 is a front view taken in the direction of arrow 9 in FIG. 8.

The front of the upper portion 40 of the casing 38 can also be provided with a paper money intake slot 52*a*, as shown in phantom in FIG. 2. A piece of paper money 24*a*, also shown in phantom, is inserted into the slot 52*a* to activate a mechanism (not shown), so that the water can be dispensed into a cup 26.

A cup dispenser 84 is shown in phantom in FIG. 1 on one side 86 of the base 14, to hold a plurality of cups 26 therein. Each cup 26 can be removed from the bottom of the dispenser 84 when needed and placed onto the drip tray 48 to receive the water.

The vending machine 12 can also be designed to supply hot and cold water. Hot coffee, hot tea and hot chocolate can also be dispensed therefrom, if the proper components are built into it.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A modular vending machine for bottled water which comprises:

a) a base comprising a box shaped housing having a front wall to sit upon a floor in a building, so as to support a bottle of water mounted on top of said base;

b) a coin operated dispensing removable module mounted on the outside of said front wall, so that when a coin is inserted into said dispensing module a specific amount of water from the bottle can be dispensed into a cup placed into said dispensing module by a user;

c) a water hose extending between the bottle of water and an upper portion of said mounting area on said front wall, and a return tube extending between a lower portion of said mounting area on said front wall and a water storage compartment within said box shaped housing of said base;

d) said dispensing module comprising a generally C-shaped casing having an upper portion, an intermediate portion and a lower portion, said upper portion including a spigot fluidly coupled to said water hose so as to dispense the water therefrom, a coin intake slot and a coin return slot, an electrically powered coin discriminator directly under said coin intake slot, and a coin reject chute extending between said coin discriminator and said coin return slot so that if said coin discriminator rejects a coin inserted within said coin intake slot it will enter said coin reject chute and exit said coin return slot, said lower portion containing a drip tray to hold the cup under said spigot and catch any water spilled from the cup, an overflow pipe under said drip tray fluidly coupled to said return tube, and a compartment formed below said drip tray, and said intermediate portion including a coin accept chute extending between said coin discriminator and said compartment in said lower portion so that if said coin discriminator accepts a coin inserted with said coin intake slot it will enter said coin accept chute and drop into said compartment in said lower portion;

e) said dispensing module further including means for allowing said spring biased button to be depressed after a coin inserted within said coin intake slot is accepted by said coin discriminator; and f) a lever pivotally connected within the upper portion of said casing of said dispensing module, a valve in said spigot attached to a first side of said lever, a spring biased button means mounted on said upper portion of said casing and attached to a second side of said lever, a solenoid electrically connected via a circuit to said electrically powered coin discriminator, a yoke extending from said solenoid to normally engage with said spring biased button means to prevent said spring biased button means to be depressed until a coin accepted by said coin discriminator will cause said coin discriminator to activate said solenoid to pull said yoke back and release said spring biased means to be depressed, so that when said spring biased button means is depressed said valve will open said spigot to allow some of the water to exit said spigot.

2. A vending machine for bottled water as recited in claim 1, wherein said dispensing module further includes a door hinged to one side of said compartment in said lower portion, so as to gain access into said compartment to remove coins therefrom.

3. A vending machine for bottled water as recited in claim 2, wherein said dispensing module further includes a key operated lock in said door to prevent an unauthorized removal of the coins from said compartment in said lower portion.

* * * * *